US005495847A

United States Patent [19]

Hu

[11] Patent Number: 5,495,847

[45] Date of Patent: Mar. 5, 1996

[54] SURVIVAL HOOD

[76] Inventor: Wei Hu, 10-1 Fl., No. 23, Sec. 1, Hang-Chou S. Rd., Taipei, Taiwan

[21] Appl. No.: 442,998

[22] Filed: May 17, 1995

[51] Int. Cl.[6] ..... A62B 18/08; A62B 7/08

[52] U.S. Cl. ..... 128/202.26; 128/201.22; 128/203.21; 128/204.11

[58] Field of Search ..... 128/202.26, 201.22, 128/201.23, 203.12, 203.21, 204.11; 362/34

[56] References Cited

U.S. PATENT DOCUMENTS

| | | | |
|---|---|---|---|
| 3,655,346 | 4/1972 | Cotabish et al. | 128/202.26 X |
| 3,720,823 | 3/1973 | Black et al. | 362/34 X |
| 3,774,022 | 11/1973 | Dubrow et al. | 362/34 |
| 4,814,949 | 3/1989 | Elliott | 362/34 |
| 4,840,170 | 6/1989 | Dahrendorf et al. | 128/202.26 |
| 4,963,327 | 10/1990 | Russell | 422/120 |
| 5,027,810 | 7/1991 | Patureau et al. | 128/206.24 |
| 5,119,808 | 6/1992 | Marquardt et al. | 128/201.22 |
| 5,370,828 | 12/1994 | Ladyjensky | 252/100 |

FOREIGN PATENT DOCUMENTS

| | | | |
|---|---|---|---|
| 54-20987 | 2/1979 | Japan | 128/202.26 |
| 62-97565 | 5/1987 | Japan | 128/202.26 |

*Primary Examiner*—Ren Yan
*Assistant Examiner*—Eric P. Raciti
*Attorney, Agent, or Firm*—Bacon & Thomas

[57] ABSTRACT

A survival hood including a hood for the head and neck, which has an inside pocket with at least one upward open space, and a gas generator put in the pocket inside the hood to release oxygen through a chemical reaction for breathing when it is bent inwards to break an inside chemical solution container.

2 Claims, 4 Drawing Sheets

SURVIVAL HOOD

BACKGROUND OF THE INVENTION

The present invention relates to a survival hood which protects the user against heat and poisonous gas and provides the user with oxygen for breathing.

There are known a variety of hood means for isolating poisonous gas or filtering poisonous gas from air. These apparatus are seen in U.S. Pat. No. 4,231,118 entitled "HEAD AND FACE PROTECTING HOOD"; U.S. Pat. No. 5,186,165 entitled "FILTERING CANISTER WITH DEPLOYABLE HOOD AND MOUTHPIECE"; U.S. Pat. No. 5,315,987 entitled "FILTERING CANISTER WITH DEPLOYABLE HOOD AND MOUTHPIECE". These apparatus use different air filter means to remove harmful substances from air, however, they cannot protect the user from breathing in poisonous gas. Another drawback of these apparatus is that the filter element is expensive to maintain and replace. There are also know a variety of hood means for providing air for breathing, for example: U.S. Pat. No. 4,466,432 entitled "AIR SUPPLYING HOOD", U.S. Pat. No. 4,793,342 entitled "EMERGENCY SMOKE HOOD AND BREATHING MASK", U.S. Pat. No. 4,836,197 entitled "FOLDED PROTECTIVE HOOD HAVING AN OXYGEN MASK". However, these air supplying apparatus are not safe in use because commonly use a high-pressure cylinder to provide oxygen or air for breathing.

Furthermore, the aforesaid hood means are commonly complicated to operate, heavy and inconvenient to carry. Therefore, people have little willing to use these apparatus. When these apparatus are used, user's movement will be hindered.

There are also known hood means using a gas generator to release oxygen through a chemical reaction for breathing, for example, TYPE-2 Fire Mask from CHINA NORTH INDUSTRIES CORP. However, these apparatus are commonly complicated in structure and inconvenient to carry.

SUMMARY OF THE INVENTION

The present invention has been accomplished under the circumstances in view. It is one object of the present invention to provide a survival hood which releases oxygen for breathing through a chemical reaction. It is another object of the present invention to provide a survival hood which protects the user against heat and poisonous gas. It is still another object of the present invention to provide a survival hood which is easy to operate. It is still another object of the present invention to provide a survival hood which is convenient to carry.

According to one aspect of the present invention, the survival hood comprises a hood for the head and neck, which has an inside pocket with at least one upward open space, and a gas generator put in the pocket inside the hood to release oxygen through a chemical reaction for breathing when it is bent inwards to break an inside chemical solution container.

According to another aspect of the present invention, the hood is made from transparent, fire-resisting high polymer plastics, which protects the user's head against heat and which permits the user to see through.

DETAILED DESCRIPTION OF THE PREFERRED EMBODIMENT

Figure 1:
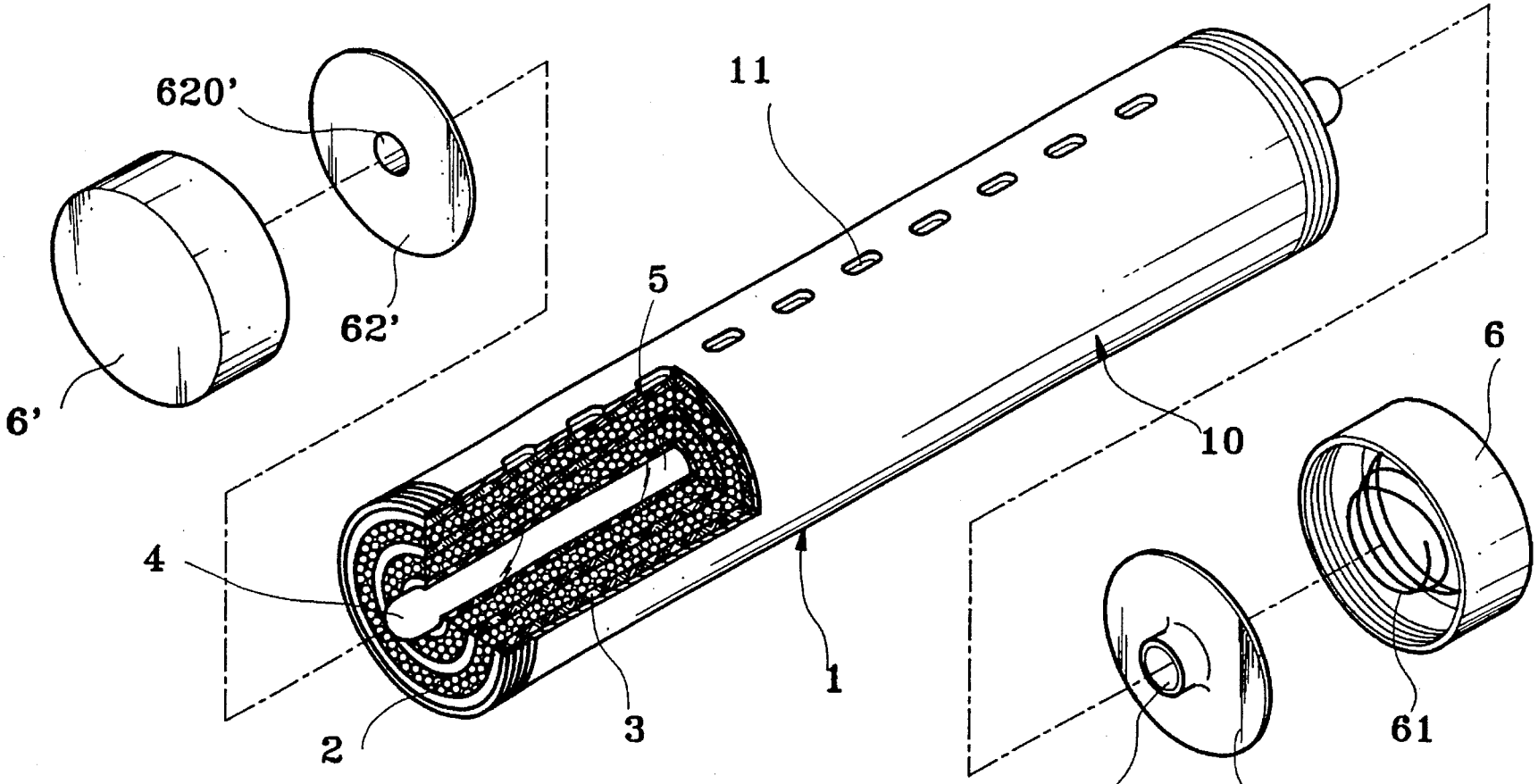
FIG. 1 is an exploded and partial cutaway view of a gas generator according to the present invention.
Figure 2:
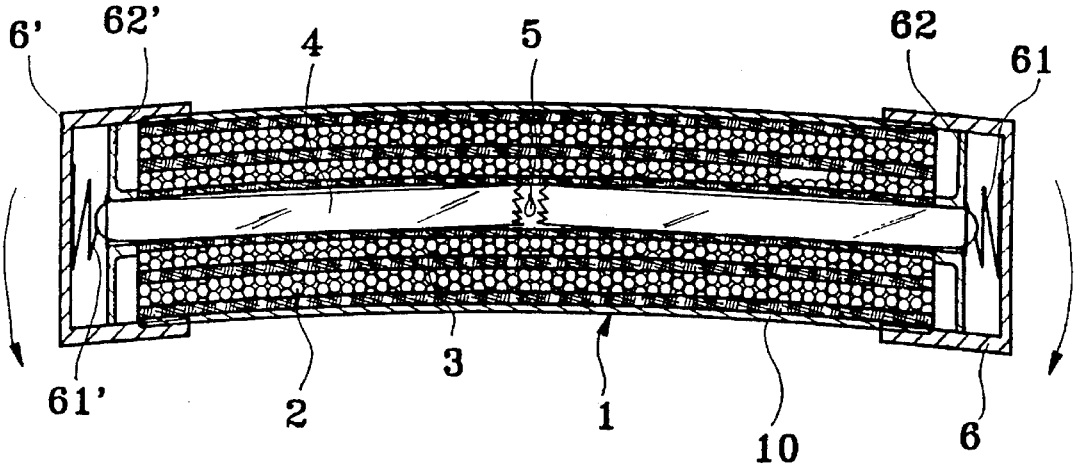
FIG. 2 is a longitudinal view in section of the gas generator shown in FIG. 1, showing the shell curved and the inside container broken.

Referring to FIGS. 1 and 2, a gas generator, referenced by 1, comprises a flexible cylindrical shell 10 having a longitudinal series of air outlets 11 through the wall, a fragile cylindrical water-tight container 4 longitudinally mounted within the shell 10 at the center, a chemical solution 5 contained in the container 4, a plurality of absorptive fiber linings 3 coaxially mounted within the shell 10 around the container 4, and layers of a solid chemical 2 filled in the spaces between the fiber linings 3. When the container 4 is broken, the chemical solution 5 is taken in the fiber linings 3 to react with the solid chemical 2, causing oxygen produced and released out of the shell 10 through the air outlets 11.

Referring to FIGS. 1 and 2 again, two packing plates 62 and 62' are respectively fastened to the two opposite ends of the shell 10 by two end caps 6 and 6'. The two opposite ends of the container 4 respectively protrude over the two opposite ends of the shell 10. The packing plate 62 or 62' has a center stub tub 620 or 620 sleeved onto the container 4 at one end. The end cap 6 or 6' is fixed to one end of the shell 10, having an inside spring 61 stopped against the packing plate 62 or 62' to force it against the respective end of the container 4. Therefore, when the two opposite ends of the gas generator 1 are bent inwards toward each other, as shown in FIG. 2, the container 4 is broken to release the chemical solution 5, permitting the chemical solution 5 to react with the solid chemical 2.

Figure 3:
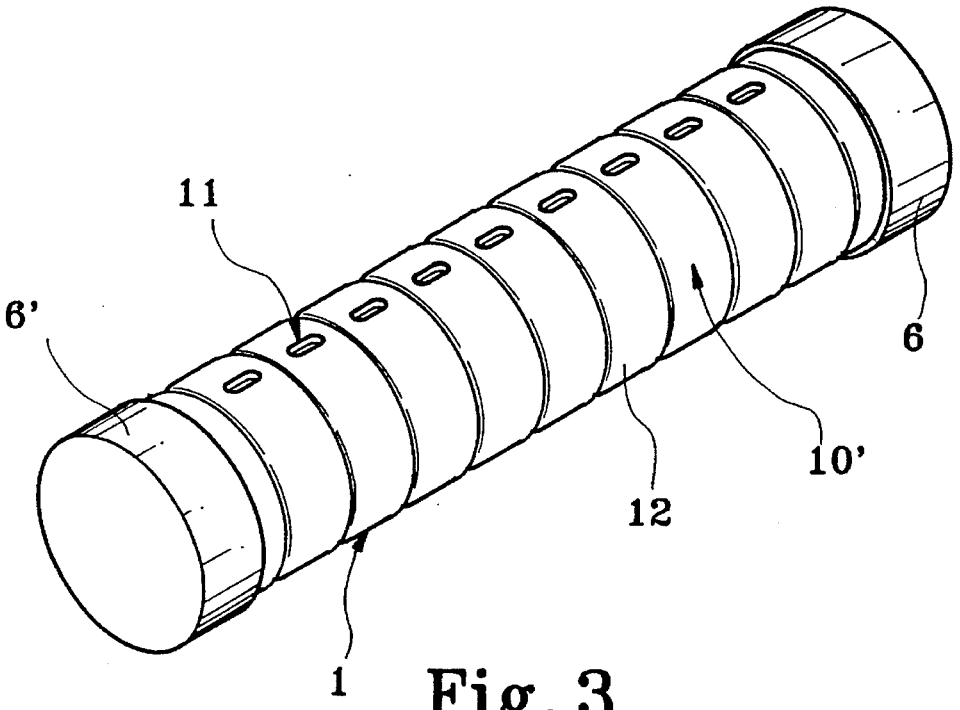
FIG. 3 is an elevational view of an alternate form of the gas generator according to the present invention.
Figure 4B:
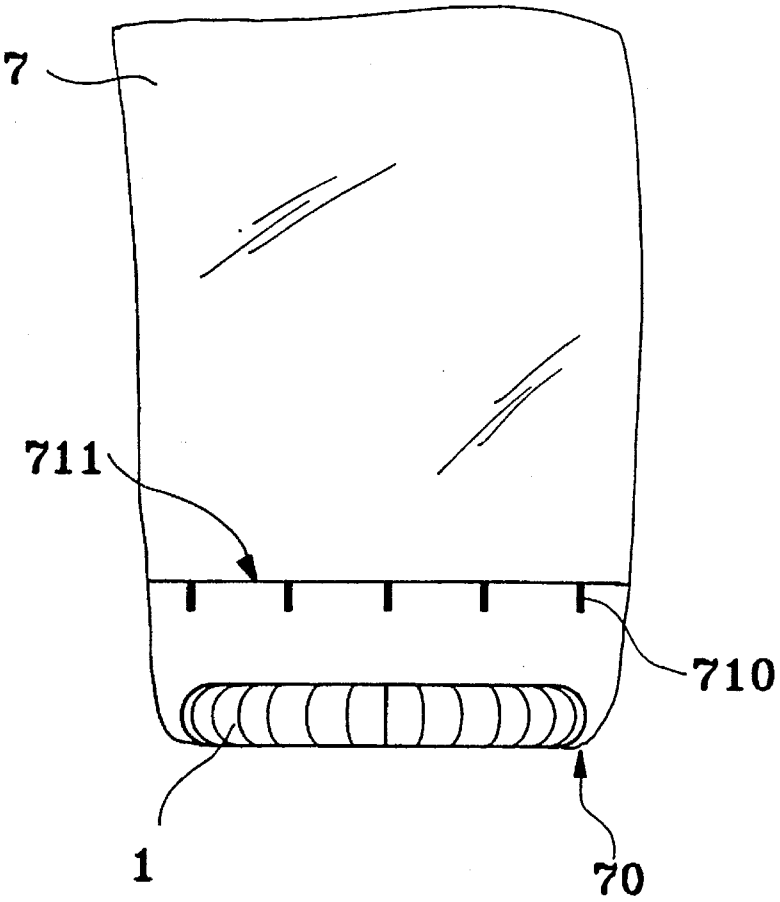
FIG. 4B is a right side view of FIG. 4A, showing the locations of the open spaces at the top side of the pocket inside the hood.
Figure 4A:
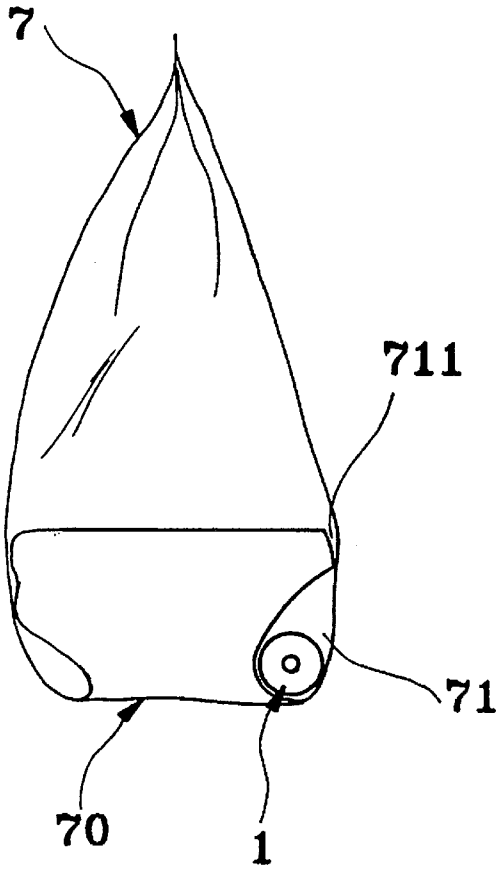
FIG. 4A shows a survival hood according to the present invention.
Figure 5A:
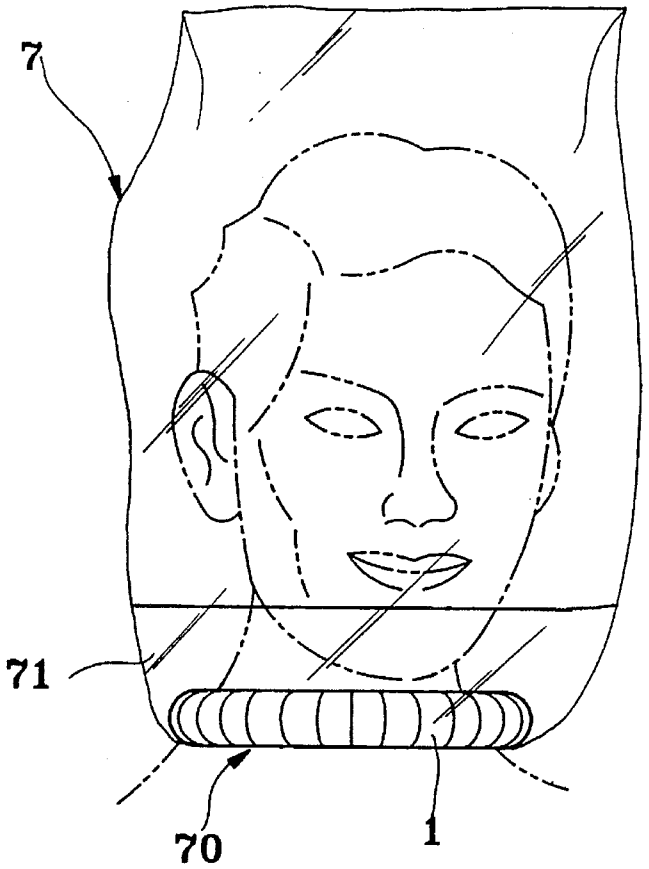
FIG. 5A is an applied view of the present invention showing the survival hood mounted around the head.
Figure 5B:
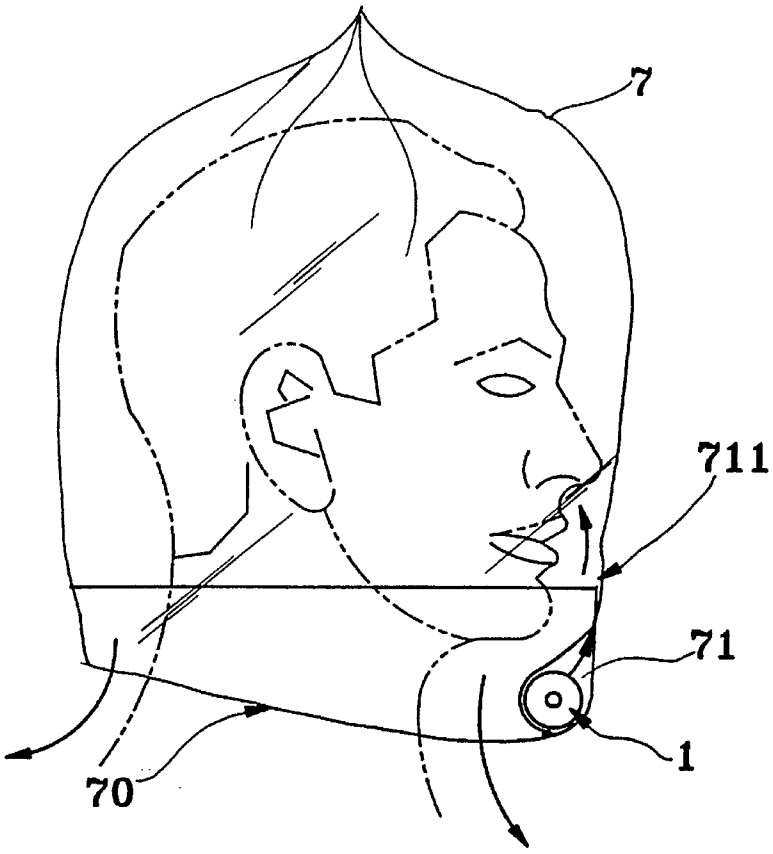
FIG. 5B is a left side view of FIG. 5A, showing oxygen released from the gas generator and waste gas exhausted from the hood.

FIG. 3 shows an alternate form of the gas generator 1, in which the shell, referenced by 10' is comprised of a longitudinal series of links 12. The links 12 permit the shell 10' to be easily bent.

Furthermore, during the manufacturing process, the container 4, the solid chemical 2, and the fiber linings 3 are rolled up into a roll and then inserted into the shell 10 or 10'. Therefore, the gas generator is easy to assemble.

Referring to FIGS. 4A, 4B, 5A, and 5B, the aforesaid gas generator 1 is mounted inside a flexible hood 7 along the border of the opening 70 of the hood 7. When in use, the flexible hood 7 is covered over the user's head around the neck. The hood 7 has at least one inside pocket 71 for carrying the gas generator 1. The at least inside pocket 71 can be formed by folding up the periphery of the opening 70 inwards and then sealing the edge to the inside wall of the hood 7 at separated points 710. Therefore, a plurality of open spaces 711 are disposed at the top side of the pocket 71 near the user's nose, and the user can efficiently breathes in oxygen from the gas generator 1 through the nose and breathe forth air out of the hood 7 outside the pocket 71.

The aforesaid hood 7 is preferably molded from transparent, fire-resisting high polymer plastics. Therefore, the hood 7 can protect the user's head against high heat and allow the user to see through.

It is to be understood that the drawings are designed for purposes of illustration only, and are not intended as a definition of the limits and scope of the invention disclosed.

I claim:

1. A survival hood comprising:

a transparent, flexible, fire-resisting hood for the head and neck, said hood comprising an opening for putting on the user's head, and at least a pocket on the inside, said pocket having at least one upward outlet at an elevation lower than the user's nose and mouth; and a gas generator carried in said pocket of said hood for releasing oxygen for breathing, said gas generator comprising a flexible cylindrical shell having a longitudinal series of air outlets, a fragile cylindrical watertight container longitudinally mounted within said shell at the center, a chemical solution contained in said container, a plurality of linings coaxially mounted within said shell around said container, layers of a solid chemical filled in spaces between said linings, and two end cap means respectively fixed to said shell at two opposite ends to hold two opposite ends of said container for holding by hand to bend said shell and said container in breaking said container, permitting said chemical solution to mix with said solid chemical in releasing oxygen through said air outlet for breathing.

2. The survival hood of claim 1 wherein said layers of linings are made from absorptive fibers that suck in said chemical solution when said container is broken, permitting said chemical solution to react with said solid chemical in releasing oxygen.

* * * * *